United States Patent [19]

Tomaszewski et al.

[11] Patent Number: 4,462,874

[45] Date of Patent: Jul. 31, 1984

[54] CYANIDE-FREE COPPER PLATING PROCESS

[75] Inventors: Lillie C. Tomaszewski, Dearborn; Robert A. Tremmel, Woodhaven, both of Mich.

[73] Assignee: OMI International Corporation, Warren, Mich.

[21] Appl. No.: 551,135

[22] Filed: Nov. 16, 1983

[51] Int. Cl.[3] ..... C25D 3/38

[52] U.S. Cl. ..... 204/52 R; 204/231; 204/290 R; 204/293; 428/680

[58] Field of Search ..... 204/52 R, 231, 293, 204/290 R; 428/680

[56] References Cited

U.S. PATENT DOCUMENTS

| | | | |
|---|---|---|---|
| 3,806,429 | 4/1974 | Clauss et al. | 204/41 |
| 3,974,044 | 8/1976 | Tremmel | 204/43 T |
| 4,179,343 | 12/1979 | Tremmel | 204/43 T |
| 4,419,192 | 12/1983 | Dahms | 204/15 |

*Primary Examiner*—G. L. Kaplan
*Attorney, Agent, or Firm*—Richard P. Mueller

[57] ABSTRACT

A process for depositing a ductile, fine-grained adherent copper plate on a conductive substrate employing an electrolyte containing controlled effective amounts of cupric ions, a complexing agent for the cupric ions, a bath stabilizing and buffering agent, and hydroxyl and/or hydrogen ions to provide a pH from about 6 to about 10.5. The process includes electrolyzing the aforementioned electrolyte employing a combination of a bath soluble copper anode and an insoluble nickel-iron alloy anode containing about 10 percent to about 40 percent by weight iron and about 0.005 to about 0.06 percent sulfur to provide a copper anode area to nickel-iron alloy anode surface area ratio within a range of about 1:2 to about 4:1. The invention further contemplates a novel nickel-iron alloy anode for use in the practice of the disclosed process.

17 Claims, 3 Drawing Figures

CYANIDE-FREE COPPER PLATING PROCESS

Background of the Invention

The use of cyanide salts in copper plating electrolytes has become environmentally disfavored because of ecological considerations. Accordingly, a variety of non-cyanide electrolytes for various metals have heretofore been proposed for use as replacements for the well-known and conventional commercially employed cyanide counterparts. For example, U.S. Pat. No. 3,475,293 discloses the use of certain iphosphonates for electroplating divalent metal ions; U.S. Pat. Nos. 3,706,634 and 3,706,635 disclose the use of combinations of ethylene diamine tetra (methylene phosphonic acid), 1-hydroxyethylidene-1, 1-diphosphonic acid, and aminotri (methylene phosphonic acid) as suitable complexing agents for the metal ions in the bath; U.S. Pat. No. 3,833,486 discloses the use of water soluble phosphonate chelating agents for metal ions in which the bath further contains at least one strong oxidizing agent; while U.S. Pat. No. 3,928,147 discloses the use of an organophosphorus chelating agent for pretreatment of zinc die castings prior to electroplating with electrolytes of the types disclosed in U.S. Pat. Nos. 3,475,293, 3,706,634 and 3,706,635.

While the electrolytes and processes disclosed in the aforementioned United States patents have provided satisfactory electrodeposits under carefully controlled conditions, such electrolytes and processes have not received widespread commercial acceptance in view of one or more problems associated with their practice. A primary problem associated with such prior art electrolytes has been inadequate adhesion of the copper deposit to zinc and zinc alloy substrates. Another such problem relates to the sensitivity of such electrolytes to the presence of contaminants such as cleaners, salts of nickel plating solutions, chromium plating solutions and zinc metal ions introduced into the electrolyte during conventional commercial practice. Still another problem is the hazardous nature of strong oxidizing agents employed in certain of such prior art electrolytes.

The present invention overcomes many of the problems and disadvantages associated with prior art cyanide-free copper plating solutions by providing a process employing an electrolyte which is cyanide-free providing an environmentally manageable system, which will function to produce an adherent copper deposit on conductive substrates including steel, brass and zinc base metals such as zinc die casts and the like; which will efficiently produce ductile, fine-grained copper deposits at thicknesses usually ranging from about 0.015 to about 5 mils (0.000015 to about 0.005 inch), which is more tolerant of the presence of reasonable concentrations of contaminants such as cleaning compounds, salts of nickel and chromium plating solutions and zinc metal ions as normally introduced into a plating bath in a commercial practice, and which is of efficient and economical operation. The invention further encompasses a novel insoluble alloy anode employed in the practice of the process.

Summary of the Invention

The benefits and advantages of the present invention are achieved in accordance with the process aspects thereof by employing a cyanide-free aqueous electrolyte containing controlled, effective amounts of cupric ions, an organo-phosphonate chelating agent, a buffering agent, hydroxyl and/or hydrogen ions to provide a pH from mildly acid to moderately alkaline, and optionally but preferably, a wetting agent. The copper ions may be introduced by a bath soluble and compatible copper salt, to provide a cupric ion concentration in an amount sufficient to electrodeposit copper, and generally ranging from as low as about 3 to as high as about 50 grams per liter (g/l) under selected conditions. The organo-phosphonate chelating agent is a compound selected from the group consisting of 1-hydroxy-ethylidene-1, 1-diphosphonic acid (HEDP) by itself present in an amount of about 50 to about 500 g/l, a mixture of HEDP and aminotri - (methylene phosphonic acid) (ATMP) in which HEDP is present in an amount of at least about 50 percent by weight of the mixture, and a mixture of HEDP and ethylenediamine tetra (methylene phosphonic acid) (EDTMP) in which HEDP is present in an amount of at least about 30 percent by weight of the mixture, as well as the bath soluble and compatible salts and partial salts thereof. When mixtures of HEDP and ATMP or HEDP and EDTMP are employed as the chelating agent instead of HEDP by itself, a reduction in the concentration of the chelating agent can be used due to the increased chelating capacity of the ATMP and EDTMP compounds in comparison to that of HEDP. The concentration of the organophosphonate chelating agent will range in relationship to the specific amount of copper ions present in the bath and is usually controlled to provide an excess of the chelating agent relative to the copper ions present.

In addition to the foregoing, the bath contains a suitable compound such as alkali metal carbonates, acetates and/or borates as a stabilizing agent as well as a buffering agent which is present in an amount usually of at least about 5 up to about 100 g/l with amounts of at least about 20 g/l being required in most instances. The bath further contains hydroxyl and/or hydrogen ions to provide an electrolyte from mildly acidic (pH 6) to moderately alkaline (pH 10.5) with a pH of about 9 to about 10 being usually preferred. The bath may optionally and preferably further contain a bath soluble and compatible wetting agent present in an amount up to about 0.25 g/l.

In accordance with the process of the present invention, the cyanide-free electrolyte as hereinabove described is employed for electrodepositing a fine-grained ductile, adherent copper strike on conductive substrates including ferrous-base substrates such as steel, copper-base substrates such as copper, bronze and brass; and zinc-base substrates including zinc die castings. The substrate to be plated is immersed in the electrolyte as a cathode and a soluble copper anode in combination with an insoluble nickel-iron anode is employed to provide a copper anode to nickel-iron alloy anode surface area ratio of about 1:2 to about 4:1. The electrolyte is electrolyzed by passage of current between the cathode and anode for a period of time of about 1 minute to as long as several hours and even days in order to deposit the desired thickness of copper on the cathodic substrate. The bath can be operated at a temperature of from about 100° to about 160° F. with temperatures of about 110° to about 140° F. being preferred. The particular temperature employed will vary depending on the specific bath composition in order to optimize plate characteristics. The bath can be operated at a current density of about 1 to about 80 amperes per square foot (ASF), depending on bath composition, employing a cathode to anode ratio usually of about 1:1 to about 1:6. It has been surprisingly discovered, that uniform, adherent and fine-grained deposits are obtained by electrifying the substrates prior to immersion in the electrolyte. In the case of zinc-base substrates, electrification of the part at a voltage of at least about 3 volts has been found necessary to attain satisfactory adhesion of the copper deposit. The specific operating parameters and composition of the electrolyte will vary depending upon the type of basis metal being plated, the desired thickness of the copper plate to be deposited, and time availability in consideration of the other integrated plating and rinsing operations.

The present invention further contemplates a novel nickel-iron insoluble anode which is employed in the process in conjunction with a soluble copper anode in controlled anode surface ratios thereby achieving the desired oxidizing medium for maintaining appropriate plating conditions and for achieving copper electrodeposits of the desired characteristics. The insoluble nickel-iron alloy anode is preferably of a composite construction comprising a conductive core having an adherent nickel-iron alloy electrodeposit bonded thereover containing from about 10 percent up to about 40 percent by weight iron in the alloy and from about 0.005 up to about 0.06 percent sulfur. The core is comprised of metals such as copper, aluminum, iron and other conductive alloys of which copper itself comprises the preferred core material. The nickel-iron alloy coating or plating on the core is further characterized as being substantially nonporous and may be as thin as 1 to 2 mils (0.001 to 0.002 inch) thick.

Additional benefits and advantages of the present invention will become apparent upon a reading of the Description of the Preferred Embodiments considered in conjunction with the accompanying examples.

Description of the Preferred Embodiments

Figure 1:
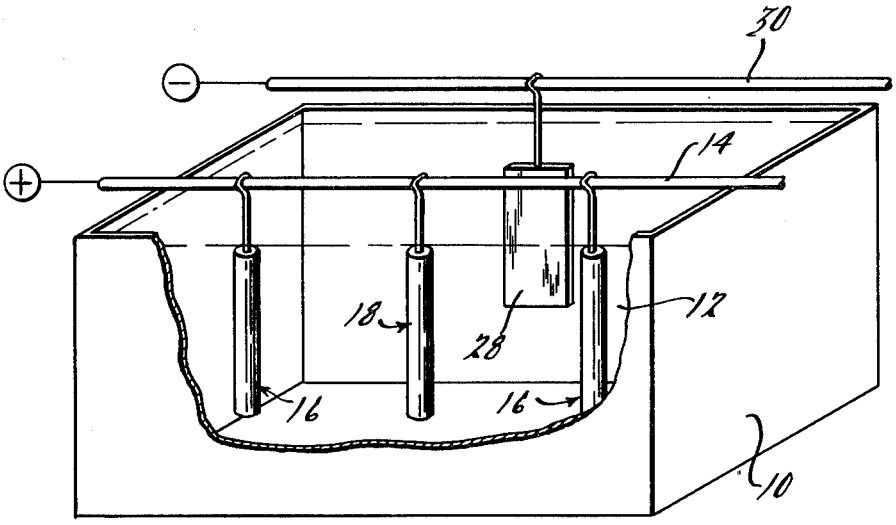
FIG. 1 is a schematic perspective view partly in section illustrating a plating receptacle suitable for use in the practice of the present process.

A cyanide-free electrolyte suitable for use in the practice of the present invention contains as its essential constituents, copper ions, an organo-phosphonate complexing agent in an amount sufficient to complex the copper ions present, a stabilizing and buffering agent comprising a bath soluble and compatible carbonate, borate and/or acetate compound, as well as mixtures thereof, a pH of about 6 to about 10.5, and optionally, a wetting agent.

The copper ions are introduced during makeup of the electrolyte by employing any one or mixtures of bath soluble and compatible copper salts such as sulfate, carbonates, oxides, hydroxides, and the like. Of the foregoing, copper sulfate in the form of a pentahydrate ($CuSO_4.5H_2O$) is preferred. The copper ions are present in the bath within the range of about 3 up to about 50 g/l, typically from around 5 to about 20 g/l. For example, when plating steel substrates, copper ion concentrations of about 15 up to about 50 g/l are employed to achieve a high rate of copper electrodeposition. In such instances in which the copper ion concentration is above about 20 g/l, it has been found by experimentation that electrified part entry into the bath is preferred to attain satisfactory adhesion. On the other hand, when plating zinc-base substrates such as zinc die castings, for example, copper ion concentrations of about 3.5 to about 10 g/l are preferred and in which instance the part must be electrified at the time of bath immersion to achieve an adherent deposit. During use of the electrolyte, a replenishment of the copper ions consumed during the electrodeposition operation as well as those removed by drag-out is achieved by the progressive dissolution of a copper anode employed in electrolyzing the bath.

The complexing or chelating agent comprises an organo-phosphorus ligand of an alkali metal and alkaline earth metal salt of which calcium is not suitable due to precipitation. Preferably, the complexing salt comprises an alkali metal such as sodium, potassium, lithium and mixtures thereof of which potassium constitutes the preferred metal. The complexing agent is present in the bath in consideration of the specific concentration of copper ions present.

The specific organo-phosphorus ligand suitable for use in accordance with the practice of the present invention comprises a compound selected from the group consisting of 1-hydroxyethylidene -1, 1-diphosphonic acid (HEDP) by itself present in an amount of about 50 to about 500 g/l, a mixture of HEDP and aminotri(-methylene phosphonic acid) (ATMP) in which HEDP is present in an amount of at least about 50 percent by weight of the mixture, and a mixture of HEDP and ethylenediamine tetra (Methylene phosphonic acid) (EDTMP) in which HEDP is present in an amount of at least about 30 percent by weight of the mixture, as well as the bath soluble and compatible salts and partial salts thereof. When mixtures of HEDP and ATMP or HEDP and EDTMP are employed as the chelating agent instead of HEDP by itself, a reduction in the concentration of the chelating agent can be used due to the increased chelating capacity of the ATMP and EDTMP compounds in comparison to that of HEDP. Commercially available compounds of the foregoing types which can be satisfactorily employed in the practice of the present invention include Dequest 2010 (HEDP), Dequest 2000 (ATMP) and Dequest 2041 (EDTMP) available from Monsanto Company.

As previously indicated, the HEDP chelating agent can be employed at a concentration of about 50 g/l corresponding to a copper ion concentration of about 3 g/l up to a concentration of about 500 g/l corresponding to a copper ion concentration of about 50 g/l, with intermediate concentrations proportionately scaled in consideration of corresponding intermediate concentrations of copper ions. When a mixture of HEDP and ATMP is employed, preferably comprising about 70 percent HEDP and 30 percent by weight ATMP, it has been discovered that 14 g/l HEDP and 6 g/l ATMP are satisfactory at a copper ion content of 3 g/l while 225 g/l HEDP and 97 g/l ATMP are satisfactory at a copper ion bath concentration of 50 g/l. Corresponding adjustments in the concentrations of HEDP and ATMP are proportionately made when the copper ion concentration is intermediate of the 3 and 50 g/l limits to provide satisfactory chelation with a slight excess of chelating agent present in the bath. Similarly, when a mixture of HEDP and EDTMP is employed, preferably comprising about 50 percent by weight of each compound, it has been discovered that 9 g/l HEDP and 10 g/l EDTMP are satisfactory at a copper ion concentration of about 3 g/l while 145 g/l HEDP and 166 g/l EDTMP are satisfactory at a copper ion bath concentration of about 50 g/l with proportionate adjustments in the concentrations of these two constituents in consideration of intermediate copper ion concentrations. It will also be appreciated that alternative mixtures of chelating agents within the ranges specified will require proportionate adjustments in concentration of total chelating agent present in relation to copper ion concentration in consideration of the foregoing concentration relationships which can be readily calculated and confirmed by routine testing to provide optimum performance for any given conditions in further consideration of the specific examples hereinafter set forth.

A third desirable constituent of the copper electrolyte comprises a bath soluble and compatible stabilizing and buffering agent including carbonate compounds, borate compounds, acetate compounds as well as mixtures thereof. Preferably, sodium carbonate and potassium carbonate are employed to stabilize the electrolyte against pH fluctuations and to further serve as a carrier for contaminating metal ions introduced in the bath as a result of drag-in and dissolution of the parts in the electrolyte during the electrodeposition operation. The use of the aforementioned buffering agents has further been observed, depending upon the particular chelating agent used, to inhibit the formation of smutty copper deposits and eliminate dark copper deposits in the cathode low current density areas. Ammonium ions have been found undesirable in some instances because of a loss of adhesion of the electrodeposit while calcium ions are undesirable because of the tendency to form precipitates in the bath. The concentration of the buffer can broadly range from about 3 up to about 100 g/l calculated as the sodium salt, preferably about 10 to about 20 g/l. Concentrations of the buffering agent below the recommended minimum concentrations will result in pH fluctuations whereas concentrations above the maximum range specified do not appear to have any adverse effects on the operation of the electrolyte.

Since the buffering agent and complexing agent are subject to depletion by both decomposition and drag-out, a replenishment of these two chemicals to maintain the electrolyte within appropriate composition limits is necessary during commercial operation. This can conveniently be performed on an intermittent or continuous basis in response to an analysis of bath composition by adding the two constituents separately or in admixture in appropriate proportions.

The electrolyte is adjusted to provide a pH of from about 6 up to about 10.5 with a pH of about 9 to about 10 being preferred. Typically an operating pH of about 9.5 has been found particularly satisfactory. The appropriate pH of the electrolyte can be maintained by adding an alkali metal hydroxide to the electrolyte to raise the pH of which potassium hydroxide is preferred. In order to reduce the pH within the desired range, a mineral acid or an alkali metal bicarbonate can be employed of which potassium bicarbonate constitutes a preferred material. When the operating pH decreases below the recommended level, it has been observed that the electrolyte tends to promote poor adhesion of the copper deposit on the substrate. On the other hand, at an operating pH above the recommended range, it has been observed in some instances, that the copper deposit becomes grainy and of a burnt characteristic. It has been found that at a pH of below about 7.5 down to about 6, satisfactory adhesion and deposit appearance can be obtained on copper and copper alloy substrates. However, when plating ferrous and zinc base substrates, a pH above about 7.5 to about 10.5 has been found to provide best results.

In addition to the foregoing constituents, the bath may optionally further contain a wetting agent or surfactant which is bath soluble and compatible with the other constituents therein. When such a surfactant is employed, it can be used in concentrations up to about 0.25 g/l with amounts of from about 0.01 to about 0.1 g/l being preferred. Typical surfactants suitable for use in the practice of the present invention include polyethylene oxides such as Carbowax 1000, alkyl sulfates such as 2-ethyl hexyl sulfate provided that the bath is carbon filtered to remove degradation products formed during operation, perfluoro anionic wetting agents, and the like.

In the practice of the process of the present invention, the electrolyte can be operated at a temperature of from about 100° to about 160° F., preferably from about 110° to about 140° F. with temperatures of about 120° to about 140° F. being typical. The specific temperature employed will vary depending on bath composition such as will become apparent in the specific examples subsequently to be described. The bath can operate at a cathode current density of from about 1 to about 80 ASF with a current density of about 5 to about 25 ASF being preferred.

The electrodeposition of the copper deposit can be performed in consideration of the other operating parameters of the bath within a time of as little as 1 minute to as long as several hours or even days with plating times of about 2 minutes to about 30 minutes being more usual for strike deposits. The specific time of electrodeposition will vary depending upon the thickness of the plate desired which will typically range from about 0.015 to about 5 mils.

The electroplating operation is performed by immersing the conductive substrate to be plated in the electrolyte and connecting the substrate to the cathode of a direct current source. It has been found that when the copper ion concentration is above about 20 g/l, it is advantageous, and usually necessary, to electrify the substrate prior to and during immersion in order to achieve good adherence of the copper plate on ferrous-base substrates. In the case of zinc-base substrates, it has been found essential at all copper ion bath concentrations to electrify the zinc-base substrate prior to and during entry into the bath at a minimum potential of about 3 volts to achieve satisfactory adhesion of the copper plate on the zinc-basis substrate.

A combination of anodes are employed for electrolyzing the bath and effecting the deposition of a copper plating on the cathode. The combination of anodes includes a copper anode of any of the types well-known in the art such as an oxygen-free high purity copper anode which is soluble and replenishes the copper ions consumed from the bath by electrodeposition and drag-out. It has been observed that when the concentration of copper ions falls below the recommended minimum concentration, a reduction in cathode efficiency occurs accompanied by burnt deposits. On the other hand, concentrations of copper ions above the recommended maximum range has been observed to adversely affect the adhesion of the copper deposit. While replenishment of copper ions can be effected by the addition of copper salts to the electrolyte, it is preferred to effect replenishment by dissolution of the copper anode at a rate substantially corresponding to the depletion rate of the copper ions by an appropriate adjustment of the copper anode surface relative to the insoluble nickel-iron alloy anode surface. The specific copper anode surface area to nickel-iron alloy anode surface area ratio can range from about 1:2 up to about 4:1 with a ratio of about 1:1 to about 2:1 being preferred. Moreover the ratio of the surface area of the cathode to the total anode surface area can range from about 1:1 up to about 1:6, preferably about 1:3 to about 1:5 and typically, about 1:4.

The insoluble nickel-iron alloy anode employed in controlled combination with the soluble copper anode may be of an integral or composite construction providing at least an exterior surface stratum which is comprised of a nickel-iron alloy containing from about 10 percent up to about 40 percent by weight iron and the balance essentially nickel, preferably about 15 to about 30 percent iron. In accordance with a preferred form of the present invention, the insoluble nickel-iron alloy anode is comprised of an electrically conductive core having an adherent electrodeposit of the nickel-iron alloy over the surfaces thereof of a thickness sufficient to envelop the core material preventing its exposure over prolonged periods of use. The nickel-iron alloy deposit or coating is further characterized as being substantially nonporous effectively sealing the internal core from exposure to the electrolyte. In such composite anode constructions, the core material may comprise metals such as copper, alloys of copper, ferrous-base cores including iron and steel, aluminum and alloys of aluminum, nickel and the like. Of the foregoing, a high purity copper core similar to the copper anode employed in conjunction with the insoluble nickel-iron anode is preferred since inadvertent exposure of the core as a result of damage or as a result of progressive dissolution of the coating or plating over prolonged periods of time does not adversely affect the operation of the bath in that copper ions are introduced in a manner similar to those introduced by the conventional soluble copper anodes. In contrast, when ferrous-base cores are employed, inadvertent exposure of the core to the electrolyte results in a progressive dissolution of iron introducing iron ions into the electrolyte which ultimately adversely affects the quality of the copper deposit produced rendering the process commercially unsatisfactory. It has been observed that concentrations of iron ions in the electrolyte in excess of about 325 ppm are detrimental and tend to produce dull, grainy copper deposits of the burnt type. Moreover, the contaminating iron ions cannot be readily removed in view of the complexing agent in the electrolyte which complexes such contaminating iron ions very strongly. While cores comprised of nickel or alloys of nickel can also be satisfactorily employed, their lower electrical conductivity and relatively higher cost renders them less desirable than copper cores.

In accordance with a preferred practice of the present invention, the insoluble nickel-iron alloy anode is produced by electrodepositing a nickel-iron alloy plate on a conductive core which has been subjected to appropriate preplating steps to render the substrate receptive to the electrodeposition of a nickel-iron alloy in accordance with conventional preplate practices well known in the art for metal substrates. When an aluminum or aluminum alloy core is employed preplate steps such as zincate, bronze alloy or anodizing are employed in accordance with well-known practices to render the core receptive to the nickel-iron plating operation. The electrolyte for depositing the nickel-iron alloy deposit on the anode core may comprise any of the types well known in the art such as described, for example, in U.S. Pat. Nos. 3,806,429; 3,974,044 and 4,179,343 which are assigned to the same assignee as the present invention and the teachings of which are incorporated herein by reference. It will be appreciated that the compositions and processes as described in the aforementioned United States patent are primarily intended for producing an extremely bright decorative nickel-iron alloy deposit on a conductive substrate simulating that of a conventional bright nickel deposit. A very bright leveled nickel-iron deposit is not essential to the satisfactory operation of the insoluble nickel-iron alloy anode of the present invention in that the alloy deposit is of a functional rather than a decorative plating and accordingly, semi-bright, satin and even relatively dull nickel-iron electrodeposits can be employed. In view of the foregoing, the particular concentration and types of primary and secondary brighteners employed in the aforementioned United States patents can be varied and reduced in concentration to provide an adherent and ductile nickel-iron plating of the desired alloy composition.

The nickel-iron alloy electrolyte contains organic sulfur compounds to introduce sulfur in the resultant alloy deposit to provide satisfactory operation and which also enhances the adhesion of the plate to the anode core. It has been found that sulfur contents in amounts of about 0.005 up to about 0.06 percent by weight preferably about 0.01 to about 0.04 percent by weight, in the nickel-iron alloy deposit is necessary to provide satisfactory performance as an insoluble anode in the practice of the present process. Typically, the sulfur content in the nickel-iron alloy electrodeposit is about 0.02 to about 0.03 percent by weight.

It has been found that the composition of the alloy is important in attaining the appropriate oxidizing medium in the copper electrolyte to provide a copper electroplating process which is commercially acceptable from the standpoint of ease of control, maintenance and replenishment and in the quality of the copper plate produced. While iron concentrations of about 10 percent to about 40 percent by weight have been found satisfactory, particularly satisfactory results are obtained at iron concentrations of about 15 to about 30 percent iron, especially of about 20 to about 25 percent iron with the balance essentially nickel. Surprisingly, an anode consisting essentially of pure iron will not work in the practice of the present process in that it rapidly dissolves causing a rapid increase in iron ion concentration rendering the bath inoperative for the reasons previously set forth. Similarly, substantially pure nickel anodes have been found unsatisfactory in spite of the fact they are relatively insoluble. Substantially pure nickel anodes have been found inadequate for providing the desired oxidizing medium to achieve proper plating performance over prolonged time periods. Similarly, nickel-iron alloys devoid of any sulfur have been found unsatisfactory after relatively short periods of use such as about 8 hours. On the other hand, sulfur contents in excess of about 0.06 percent in the nickel-iron alloy are unsatisfactory for sustained commercial operation.

Referring now in detail to the drawing, and as shown in FIG. 1 thereof, a typical electroplating arrangement is schematically illustrated suitable for use in the practice of the present invention. As shown, the apparatus includes a tank 10 filled with the cyanide-free alkaline copper electrolyte 12 and having an anodically charged bus bar 14 disposed thereabove from which a pair of soluble copper anodes 16 and an insoluble nickel-iron alloy anode 18 are suspended in electrical contact therewith. The ratio of the anode surface area of the soluble and insoluble anode or anodes is important to achieve proper operation of the bath during sustained commercial operation. By appropriate proportioning of the copper anode surface area and nickel-iron alloy anode surface area within a range of about 1:2 up to about 4:1, preferably at ratios of about 1:1 up to about 2:1, the chemistry of the electrolyte is maintained with appropriate additions of the complexing and buffering agents and small additions, if necessary, of the copper salt. When the ratio of the copper anode surface area to nickel-iron anode surface area falls below about 1:2, i.e. when the total copper anode surface area falls below about 33 percent of the total anode surface area, the copper anode has been observed to tend to polarize in which condition it remains conductive but no longer dissolves at the desired rate resulting in dull and grainy copper deposits. This also necessitates increased replenishment of copper ions by the addition of soluble salts which is associated with the formation of degradation products in the bath. Accordingly, while the process can be operated for short time periods at a copper anode surface area to nickel-iron alloy anode surface area ratio of less than about 1:2, such operation is not commercially practical over prolonged time periods.

Figure 2:
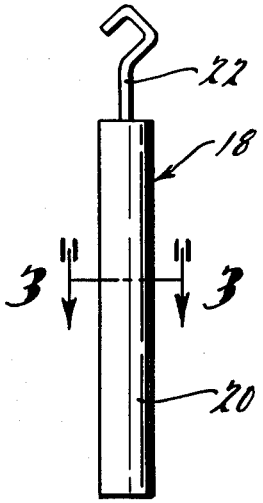
FIG. 2 is a side elevational view of an insoluble nickel-iron alloy anode employed in the practice of the process of the present invention.
Figure 3:
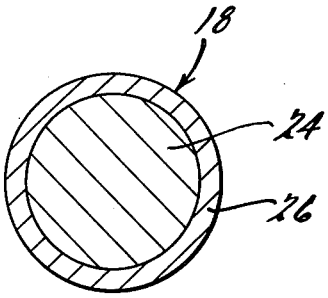
FIG. 3 is a magnified transverse cross-sectional view of the anode shown in FIG. 2 and taken substantially along the line 3—3 thereof.

Referring now to FIG. 2 of the drawing, the insoluble nickel-iron alloy anode constructed in accordance with a preferred embodiment of the present invention is of a composite construction comprising an elongated bar 20 securely connected at its upper end to a hook-shaped member 22 which preferably is comprised of an inert conductive material such as titanium, for example. The elongated bar 20 as best seen in FIG. 3 is comprised of a central conductive core 24 which may be of a solid or tubular construction having an adherent outer stratum or plating 26 overlying the entire outer surface thereof. The particular configuration of the nickel-iron alloy anode is not critical in achieving satisfactory performance thereof and the shape as well as the cross-sectional configuration can be varied in accordance with known practices to achieve optimum throwing power and uniformity in the characteristics and thickness of the copper electrodeposit consistent with the nature of the substrates being plated.

During an electroplating operation, a substrate or workpiece 28 to be copper plated is immersed in the electrolyte 12 in the tank 10 of FIG. 1 generally supported from a suitable cathodically charged bus bar 30 and current is passed between the anode and the substrate for a period of time sufficient to deposit the desired thickness of copper on the substrate.

While the replenishment of the complexing agent during operation of the electrolyte is usually done employing a neutralized alkali metal salt thereof to avoid a drastic reduction in the operating pH of the electrolyte, it is contemplated that the acid form of the complexor can be used for original or new bath makeup by first dissolving the acid form complexor in water followed by the addition of a base such as potassium hydroxide to increase the pH to a level above about 8. Thereafter, the buffering agent can be added to the preliminary solution in which a neutralization of the complexer has been accomplished in situ.

In order to further illustrate the process and novel anode of the present invention, the following specific examples are provided. It will be understood that the examples as hereinafter set forth are provided for illustrative purposes and are not intended to be limiting of the scope of this invention as herein disclosed and as set forth in the subjoined claims.

EXAMPLE 1

A composite nickel-iron alloy anode comprising an electrodeposited nickel-iron alloy on a solid copper core is prepared employing an electrolyte of the following composition:

| | Optimum | Range |
|---|---|---|
| $Ni^{+2}$ | 56 g/l | 35–100 g/l |
| $Fe^{+2}$ and $Fe^{+3}$ | 4 g/l | 1–10 g/l |
| $NiSO_4[6H_2O]$ | 150 g/l | 50–300 g/l |
| $NiCl_2[6H_2O]$ | 100 g/l | 30–150 g/l |
| $H_3BO_3$ | 45 g/l | 30–Saturation |
| Sodium Gluconate | 20 g/l | 5–100 g/l |
| Sodium Saccharin | 2.5 g/l | 0–10 g/l |
| Sodium Allyl Sulfonate | 4.0 g/l | 0.5–15 g/l |
| Wetting Agent | 0.2 g/l | 0.05–1.0 g/l |
| pH | 2.9 | 2.5–4.0 |
| Agitation | Air, Cathode Bar or Still | |
| Temperature | 135° F. | 100–160° F. |
| Cathode Current Density | 40 ASF | 5–100 ASF |
| Anodes | Iron and Nickel | |

The wetting agent employed includes low foaming type wetting agents such as sodium octyl sulfate when employing air agitation and relatively high foaming wetting agents such as sodium lauryl sulfate when employing cathode bar agitation or still baths. Sodium gluconate in the electrolyte composition comprises a complexing agent for the ferric ions and alternative satisfactory complexing agents or mixtures thereof can be employed for this purpose including citrates, tartrates, glucoheptonates, salicylates, ascorbates or the like.

Alternative complexing agents which can be satisfactorily employed include those as described in the aforementioned U.S. Pat. Nos. 3,806,429; 3,974,044 and 4,179,343 the substance of which is incorporated herein by reference. The anodes employed in the nickel-iron electroplating process are in the form of individual slabs or chips of iron and nickel in separate baskets.

The composition of the nickel-iron electrolyte in accordance with the optimum composition as set forth in the foregoing table produces a nickel-iron alloy deposit containing approximately 20 percent iron and the balance essentially nickel using cathode bar agitation. When air agitation is employed, the iron concentration in the electrodeposit will increase to about 30 percent by weight. When no agitation is employed, the iron concentration in the electrodeposit will decrease to about 15 percent by weight. In accordance with a preferred practice of the present invention, cathode bar or mild air agitation is employed in that the electrodeposit is more uniform in both composition as well as in appearance.

In the formulation of suitable nickel-iron electrolytes, the ratio of nickel ions to iron ions is perhaps the single most important factor in determining the composition of the final alloy electrodeposit. In accordance with the optimum formulation, a nickel to iron ratio of about 14:1 employing cathode bar agitation provides an iron concentration in the alloy electrodeposit of about 20 percent by weight. At a higher nickel to iron ion ratio, a lower iron concentration in the deposit is produced whereas at a lower nickel:iron ratio, a higher iron concentration in the alloy is produced. In either event, the electrolyte and the conditions of operation are controlled so as to provide a nickel-iron alloy deposit containing from about 15 percent up to about 30 percent by weight iron.

An elongated copper core is employed for forming a composite nickel-iron alloy anode and is subjected to a conventional pretreatment prior to plating in the aforementioned electrolyte. The pretreatment can typically comprise an alkaline soak treatment for a period of about 1 to about 3 minutes followed by a cathodic electrocleaning step for a period of about 1 to about 2 minutes followed by a cold water rinse. The rinsed copper core is thereafter subjected to a soak treatment in a 5 to 10 percent sulfuric acid solution for a period of about 15 to about 30 seconds followed by a cold water rinse. The pretreated copper core is thereafter immersed in the aforementioned nickel-iron electrolyte and is electroplated for a period of 1 to about 2 hours at an average cathode current density of about 40 amperes per square foot (ASF) whereafter the composite anode is withdrawn, cold water rinsed and dried. The nickel-iron alloy electrodeposit is of a thickness of about 2 to about 4 mils and contains about 20 percent iron by weight and about 0.025 percent sulfur weight. In the fabrication of such nickel-iron alloy anodes, the electrodeposition of the nickel-iron alloy electrodeposit can usually range from about 0.5 mils up to about 10 mils or even thicker to achieve satisfactory operation. The important criteria of the electrodeposit is that it is substantially nonporous and is adherent to the core and is further characterized as being of good ductility and of relatively low stress. The conditions as set forth in Example 1 provide a nickel-iron electrodeposit possessed of the foregoing desirable properties.

EXAMPLE 2

A composite nickel-iron alloy anode comprising an electrodeposited nickel-iron alloy on a solid steel core is prepared employing the same procedure as set forth in Example 1 with the exception that the steel core during the pretreatment prior to plating is subjected to an anodic electrocleaning step instead of a cathodic electrocleaning step and is subsequently subjected to a soak treatment employing a more concentrated sulfuric acid solution at about 25 percent concentration for a similar time period as described in Example 1.

The resultant composite anode has a nickel-iron electrodeposit of the same characteristics as obtained in Example 1.

EXAMPLE 3

A cyanide-free aqueous alkaline electrolyte suitable for depositing a copper strike on ferrous-base substrates such as steel and on copper-base substrates such as brass is prepared by dissolving in deionized water about 25 g/l to 35 g/l of copper sulfate pentahydrate (6.25 to 8.75 g/l copper ion) under agitation. Following the complete dissolution of the copper sulfate salt, about 76.1 g/l to about 84.8 g/l of 1-hydroxy ethylidene-1,1, diphosphonic acid is added. The pH of the solution is adjusted employing a 50 percent aqueous solution of potassium hydroxide to above pH 8.0. Thereafter, from about 15 to about 20 g/l of sodium carbonate is added and the solution is agitated until complete dissolution occurs. The solution is thereafter heated to an operating temperature of from about 130° F. to 140° F. and a combination of an oxygen-free high purity copper anode and a nickel-iron alloy anode as obtained in accordance with Example 1 is immersed in the bath while suspended from an anode bar to provide a copper anode surface area to nickel-iron alloy anode surface area of about 2:1.

Air agitation is employed to reduce burning and to improve throwing power of the process. Steel and brass panels or parts are electroplated in the foregoing electrolyte for periods of about 2 to 20 minutes at cathode current densities of about 15 to 20 ASF and at a cathode to anode surface area ratio of about 1:2 to about 1:6. The bath is maintained within a pH of about 9.5 to 10.2 and the solution is vigorously agitated by air agitation. Uniform, fine-grained, ductile and adherent copper strike deposits are obtained.

EXAMPLE 4

A cyanide-free aqueous alkaline electrolyte suitable for depositing a copper deposit on ferrous-base substrates such as steel and on copper-base substrates such as brass is prepared by dissolving in deionized water, about 55 g/l to about 88 g/l of copper sulfate pentahydrate (13.5 to 22 g/l of copper ions) under agitation. Following the complete dissolution of the copper sulfate salt, about 107.9 to about 147 g/l of 1-hydroxyethylidene-1,1, diphosphonic acid are added. The pH of the solution is adjusted employing a 50 percent aqueous solution of potassium hydroxide to provide a pH of about 8.0. Thereafter from about 15 to 25 g/l of sodium carbonate is added and the solution is agitated until complete dissolution occurs. The solution is thereafter heated to about 130° to 150° F. and a combination of an oxygen-free high purity copper anode and nickel-iron alloy anode is immersed while suspended from an anode bar to provide a copper anode surface area to nickel-iron alloy anode surface area ratio of about 1:1.

While agitation is not critical, some agitation such as mechanical, cathode rod and preferably air agitation is employed to provide efficiency and throwing power of the process. Steel and brass substrates are electroplated in the foregoing electrolyte for periods of 2 to 60 minutes at a cathode current density of about 10 to 30 ASF and at a cathode to anode surface area ratio of about 1:2 to about 1:6. The bath is maintained within a pH of about 9.5 to 10.2. Uniform, fine-grained, ductile and adherent copper deposits are obtained.

The foregoing process is also suitable for copper plating steel and brass work pieces in a barrel plating operation.

EXAMPLE 5

The process as described in Example 3 is repeated for depositing a copper strike on ferrous-base substrates with the exception that a composite nickel-iron alloy anode is employed at the same copper to nickel-iron alloy anode surface ratio but containing only 11 percent by weight iron and 0.02 percent sulfur. A uniform, fine-grained, ductile and adherent copper deposit is obtained.

EXAMPLE 6

The process of Example 5 is repeated except that a composite nickel-iron alloy anode is employed containing 11 percent by weight iron and 0.067 percent sulfur. The resultant copper deposit is unacceptable comprising a grainy, reddish deposit believed to be caused by the excessive sulfur content in the nickel-iron alloy of the anode.

EXAMPLE 7

The process of Example 4 is repeated with the exception that a composite nickel-iron alloy anode is employed in which the alloy contains 32 percent by weight iron and 0.02 percent sulfur. An acceptable uniform, fine-grained, ductile and adherent copper electrodeposit is obtained.

EXAMPLE 8

The process of Example 7 is repeated with the exception that a composite nickel-iron alloy anode is employed containing about 32 percent by weight iron and sulfur at a concentration of 0.088 percent. An unacceptable grainy, reddish-brown copper deposit is obtained.

EXAMPLE 9

The process of Example 7 is repeated with the exception that a composite nickel-iron alloy anode is employed containing 60 percent by weight iron and 0.02 percent sulfur. An unacceptable grainy, brittle copper deposit is obtained which is believed due to the high iron content in the nickel-iron alloy anode.

EXAMPLE 10

The process of Example 7 is repeated with the exception that a nickel-iron alloy anode is employed containing about 25 percent iron by weight and 0.02 percent sulfur. An acceptable uniform, fine-grained, ductile and adherent copper deposit is obtained.

EXAMPLE 11

A cyanide-free aqueous alkaline electrolyte suitable for depositing a copper strike on ferrous-base substrates such as steel and on copper-base substrates such as brass is prepared by dissolving in deionized water, about 60 to about 72 g/l of copper sulfate pentahydrate (15 to 18 g/l copper ions) under agitation. Following the complete dissolution of the copper sulfate salt, about 81 to about 87 g/l of a complexing agent is dissolved comprising the neutralized potassium salt of a 30 percent by weight aminotri (methylene-phosphonic acid) (ATMP) and 70 percent by weight of 1-hydroxyethylidene-1, 1 diphosphonic acid (HEDP). The pH of the solution is adjusted employing a 50 percent aqueous solution of potassium hydroxide to provide a pH of about 8.5. Thereafter from about 15 to about 25 g/l of sodium borate is added and the solution is agitated until complete dissolution occurs. The solution is thereafter heated to an operating temperature of from about 110° to about 140° F. and a combination of an oxygen-free, high purity copper anode and a composite nickel-iron alloy anode containing 25 percent by weight iron and 0.02 percent by weight sulfur are immersed while suspended from an anode bar to provide a copper anode surface area to nickel-iron alloy anode surface area ratio of about 1:1.

While agitation is not critical, some agitation such as mechanical, cathode rod and preferably air agitation is employed to provide for improved efficiency and throwing power of the plating process. Steel and brass test panels are electroplated in the foregoing electrolyte for periods of about 2 to 20 minutes at a cathode current density of about 5 to 10 ASF and at a cathode to anode surface area ratio of about 1:2 to about 1:6. The bath is maintained within a pH of about 7.5 to 9.5 and the solution is vigorously agitated by air agitation. Substantially uniform grain-refined, ductile adherent copper strike deposits are obtained.

The foregoing process is also suitable for copper plating steel and brass parts in a barrel plating operation.

EXAMPLE 12

An electrolyte is prepared identical to that described in Example 11 except that about 15 to about 25 g/l of potassium carbonate was employed in place of sodium borate as a buffering agent. Zinc test panels are satisfactorily plated employing the same operating parameters as described in Example 11 with the exception that the test panels are electrified at a minimum voltage of 3 volts prior to and during immersion in the electrolyte to provide adherent, grain-refined ductile copper strike deposits.

While it will be apparent that the preferred embodiments of the invention disclosed are well calculated to fulfill the objects above stated, it will be appreciated that the invention is susceptible to modification, variation and change without departing from the proper scope or fair meaning of the subjoining claims.

What is claimed is:

1. A process for electrodepositing a grain refined ductile and adherent copper plate on a conductive substrate which comprises the steps of providing an aqueous cyanide-free electrolyte containing copper ions present in an amount sufficient to electrodeposit copper, a complexing agent present in an amount sufficient to chelate the copper ions present, a bath soluble and compatible buffering agent present in an amount sufficient to stabilize the pH of the electrolyte, and hydroxyl and/or hydrogen ions present in an amount to provide a pH of about 6 to about 10.5; immersing a conductive substrate to be plated as a cathode in said electrolyte, immersing a combination of a copper-base soluble anode and a nickel-iron alloy insoluble anode containing about 10 percent to about 40 percent by weight iron in said electrolyte to provide a copper anode to nickel-iron alloy anode surface area ratio of about 1:2 to about 4:1, and passing current between said anodes and said cathode for a period of time sufficient to deposit copper on said substrate to the desired thickness.

2. The process as defined in claim 1 including the further step of controlling the temperature of the electrolyte within a range of about 100° to about 160° F.

3. The process as defined in claim 1 including the further step of controlling the temperature of the electrolyte within a range of about 110° to about 140° F.

4. The process as defined in claim 1 including the further step of controlling the temperature of the electrolyte within a range of about 120° to about 140° F.

5. The process as defined in claim 1 in which the copper anode to nickel-iron alloy anode surface area ratio is controlled within a range of about 1:1 to about 2:1.

6. The process as defined in claim 1 including the further step of controlling the cathode surface area to anode surface area ratio between about 1:1 to about 1:6.

7. The process as defined in claim 1 including the further step of controlling the cathode surface area to anode surface area ratio between about 1:3 to about 1:5.

8. The process as defined in claim 1 including the further step of controlling the cathode surface area to anode surface area ratio at about 1:4.

9. The process as defined in claim 1 in which the step of passing current between said anodes and said cathode is performed to provide an average cathode current density of about 1 to about 80 ASF.

10. The process as defined in claim 1 in which the step of passing current between said anodes and said cathode is performed to provide an average cathode current density of about 5 to about 25 ASF.

11. The process as defined in claim 1 including the further step of controlling the concentration of said hydroxyl ions to provide a pH of about 9 to about 10.

12. The process as defined in claim 1 including the further step of electrifying said conductive substrate cathodically prior to and during the step of immersing said substrate in said electrolyte.

13. The process as defined in claim 12 in which the electrification of said conductive substrate is performed at a voltage of at least about 3 volts prior to and during the step of immersing said substrate in said electrolyte.

14. The process as defined in claim 1 in which said nickel-iron alloy insoluble anode contains about 15 percent to about 30 percent by weight iron.

15. The process as defined in claim 1 in which said nickel-iron alloy anode contains about 20 percent to about 25 percent by weight iron.

16. The process as defined in claim 1 in which said nickel-iron alloy anode further contains about 0.005 to about 0.06 percent sulfur.

17. The process as defined in claim 1 in which said nickel-iron alloy anode further contains about 0.01 to about 0.04 percent sulfur.

* * * * *